US010619416B1

(12) United States Patent
Snell

(10) Patent No.: US 10,619,416 B1
(45) Date of Patent: Apr. 14, 2020

(54) ATTACHMENT FOR AN EXTENSION LADDER

(71) Applicant: Jim Snell, Calgary (CA)

(72) Inventor: Jim Snell, Calgary (CA)

( * ) Notice: Subject to any disclaimer, the term of this patent is extended or adjusted under 35 U.S.C. 154(b) by 0 days.

(21) Appl. No.: 15/792,897

(22) Filed: Oct. 25, 2017

(51) Int. Cl.
*E06C 7/06* (2006.01)
*E06C 7/16* (2006.01)
*E06C 7/48* (2006.01)
*E06C 7/50* (2006.01)

(52) U.S. Cl.
CPC ..... *E06C 7/06* (2013.01); *E06C 7/16* (2013.01); *E06C 7/48* (2013.01); *E06C 7/50* (2013.01)

(58) Field of Classification Search
CPC ..... E06C 7/16; E06C 7/48
See application file for complete search history.

(56) References Cited

U.S. PATENT DOCUMENTS 799,782 A * 9/1905 Ellinger ..... E06C 7/48 182/214
1,004,284 A * 9/1911 Lehmann ..... E06C 7/48 182/121
1,216,214 A 2/1917 Connell
2,541,343 A * 2/1951 Dakin ..... E06C 7/16 248/238
2,680,554 A * 6/1954 Dakin ..... E06C 7/16 182/120
3,179,205 A * 4/1965 Rowlette ..... E06C 7/16 182/121
3,734,236 A * 5/1973 Houtler ..... E06C 7/48 182/121
4,331,217 A * 5/1982 Stecklow ..... E06C 7/48 182/107
4,445,659 A * 5/1984 LaChance ..... E06C 7/143 182/120
4,723,632 A * 2/1988 Gedgoudas ..... E06C 7/48 182/206
4,862,994 A * 9/1989 Hughes, Sr. ..... E06C 7/14 182/122
D307,187 S 4/1990 Schaf
5,052,581 A * 10/1991 Christ ..... E06C 7/14 15/257.06
5,165,501 A * 11/1992 Donahey ..... E06C 7/42 182/107
5,361,868 A * 11/1994 Bartos ..... E06C 7/46 182/111
5,647,452 A * 7/1997 Gauthier ..... E06C 7/16 182/107

(Continued)

*Primary Examiner* — Katherine W Mitchell
*Assistant Examiner* — Shiref M Mekhaeil
(74) *Attorney, Agent, or Firm* — Cramer Patent & Deisgn, PLLC; Aaron R. Cramer

(57) ABSTRACT

An attachment for an extension ladder includes a tray supported upon a pair of tray support rods and a tray support rod brace. A scuff pad is capable of being secured to the common first end of the tray support rods while the common second end is capable of being secured to an extension ladder. Each tray support rod is supported by a tray support rod angular brace which is capable of being removably secured adjacent each tray support rod first end and removably secured to the extension ladder at a support rod angular brace second end subjacent the tray support rod second end ladder attachment point. Each tray support rod and tray support rod angular brace is capable of being adjusted lengthwise.

8 Claims, 8 Drawing Sheets

(56) References Cited

U.S. PATENT DOCUMENTS

| | | | | |
|---|---|---|---|---|
| D388,883 | S | 1/1998 | Thivierge et al. | |
| 5,899,296 | A * | 5/1999 | Lantz | E06C 7/48 182/107 |
| 6,691,825 | B2 * | 2/2004 | Haig | E06C 7/14 182/107 |
| 6,698,547 | B1 * | 3/2004 | Uridel | E06C 7/14 182/107 |
| 6,698,548 | B1 | 3/2004 | Verrill | |
| D683,054 | S * | 5/2013 | Deardorf | D25/68 |
| 8,469,148 | B2 * | 6/2013 | Perry | E06C 7/14 182/122 |
| 8,881,917 | B1 * | 11/2014 | Sooknanan | B25H 3/06 211/133.3 |
| 9,771,756 | B1 * | 9/2017 | Gregoire | E06C 7/42 |
| 2004/0200667 | A1 * | 10/2004 | Babkes | B62B 1/002 182/20 |
| 2007/0181761 | A1 * | 8/2007 | Astor | E06C 7/14 248/238 |
| 2010/0200331 | A1 * | 8/2010 | Hager | E06C 1/06 182/107 |
| 2013/0220951 | A1 * | 8/2013 | Dufour | E06C 7/14 211/13.1 |
| 2017/0305602 | A1 * | 10/2017 | Mittag | B65D 25/22 |
| 2018/0327002 | A1 * | 11/2018 | Nasrabad | B61D 23/00 |

* cited by examiner

ATTACHMENT FOR AN EXTENSION LADDER

RELATED APPLICATIONS

There are no related applications.

FIELD OF THE INVENTION

The present invention relates generally to the field of an attachment for an extension ladder.

BACKGROUND OF THE INVENTION

There is a seemingly endless list of activities performed at home, work, and in m any other environments that require the use of a ladder in order to allow its user to gain access to areas that otherwise would be inaccessible. However, as handy as ladders are, they are not without their disadvantages. Perhaps the biggest disadvantage is that they do not provide a work area or storage area for the person on the ladder. This requires the person to carry any tools or supplies needed for the task with them in either in their hands, pockets, or tool belt. This obviously compromises safety as the user must constantly remove and replace each tool.

Extension ladders also suffer from the fact that there is often very little frictional force created between ladders and the supporting structure, making it dangerous to climb upon them due to the ease at which the ladder can slide and fall over. Ladder standoffs have been developed in order to remedy this situation, however they are large bulky and require burdensome adjustment for each use.

Accordingly, there is a need for a means by which the safety of extension ladders can be enhanced with regard to a safe work platform and standoff capability in order to address the shortcomings as described above. The development of the extension ladder attachment is such a solution.

SUMMARY OF THE INVENTION

The inventor has recognized the aforementioned inherent problems and lack in the art and observed that there is a need for an attachment for an extension ladder.

It is therefore an object of the invention to provide a ladder platform device, including a tray, a non-slip pad and a plurality of lengthwise support structures. At least two (2) of the plurality of support structures are removably secured to an underside portion of the tray. A first end of each of the plurality of support structures is removably secured to a first side of the non-slip pad. A second end of a first pair of each of the plurality of support structures are configured to be removably secured to a first ladder rung. A second end of a second pair of each of the plurality of support structures are configured to be removably secured to a second ladder rung. The pad is configured to lean against a vertical support structure thereby presenting the tray in a horizontal manner suitable for a usable surface for a user of the ladder. In a separate embodiment, the plurality of lengthwise support structures may be adjustable.

The plurality of support structures may include a first upper support arm, a second upper support arm, a first lower support arm and a second lower support arm. The pad may provide a first pad fastener which is secured to the first side of the non-slip pad, a second pad fastener which is secured to the first side of the non-slip pad and adjacent the first pad fastener, a third pad fastener which is secured to the first side of the non-slip pad which is adjacent the second pad fastener and a fourth pad fastener which is secured to the first side of the non-slip pad and adjacent the third pad fastener.

The pad further includes a pad block which is disposed on a second side of the non-slip pad being opposite the non-slip pad first side. The tray may further comprise a plurality of apertures and at least one depression. The underside portion of the tray may further provide a first spring clip which is adjacent a first tray corner, a second spring clip which is adjacent a second tray corner, a third spring clip which is adjacent a third tray corner and a fourth spring clip which is adjacent a fourth tray corner.

The first upper support arm may include a first upper support arm connector which has a first upper support arm connector first side and a first upper support arm connector second side, a first upper support arm first half which has a first upper support arm first half first end removably secured to the first upper support arm connector second side while also having a first upper support arm first half second end, a first upper support arm second half which has a first upper support arm second half first end which is removably secured to the first upper support arm first half second end while also having a first upper support arm second half second end and a first upper support arm connection tab which is secured to the first upper support arm second half second end. The first upper support arm connector may be secured to the first ladder rung. The first upper support arm may be removably secured between the first spring clip and the second spring clip. The first upper support arm connection tab may be removably secured to the second pad fastener.

The second upper support arm may provide a second upper support arm connector, which has a second upper support arm connector first side and a second upper support arm connector second side, a second upper support arm first half which has a second upper support arm first half first end removably secured to the second upper support arm connector second side and also having a second upper support arm first half second end, a second upper support arm second half, having a second upper support arm second half first end which is removably secured to the second upper support arm first half second end while also having a second upper support arm second half second end and a second upper support arm connection tab which is secured to the second upper support arm second half second end. The second upper support arm connector may be removably secured to the first ladder rung adjacent the first upper support arm connector. The second upper support arm may be removably secured between the third spring clip and the fourth spring clip. The second upper support arm connection tab may be removably secured to the third pad fastener. A first support brace may be secured at a first support brace end and across a distance between the first upper support arm connector and the second upper support arm connector.

The first lower support arm may include a first lower support arm connector, which has a first lower support arm connector first side and a first lower support arm connector second side, a first lower support arm first half, which has a first lower support arm first half first end removably secured to the first lower support arm connector second side, and also has a first lower support arm first half second end, a first lower support arm second half, which has a first lower support arm second half first end removably secured to the first lower support arm first half second end and also having a first lower support arm second half second end and a first lower support arm connection tab secured to the first lower support arm second half second end. The first lower support arm connector may be removably secured to the second ladder rung which is subjacent to the first ladder rung and the first lower support arm connection tab may be removably secured to the first pad fastener.

The second lower support arm is a second lower support arm connector which has a second lower support arm connector first side and a second lower support arm connector second side, a second lower support arm first half which has a second lower support arm first half first end which is removably secured to the second lower support arm connector second side while also having a second lower support arm first half second end, a second lower support arm second half, which has a second lower support arm second half first end which is removably secured to the second lower support arm first half second end while also having a second lower support arm second half second end and a second lower support arm connection tab which is secured to the second lower support arm second half second end. The second lower support arm connector is removably secured to the second ladder rung which is adjacent the first lower support arm connector. The second lower support arm connection tab may be removably secured to the fourth pad fastener. A second support brace may be secured at each second support brace end and across a distance to between the first lower support arm connector and the second lower support arm connector.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
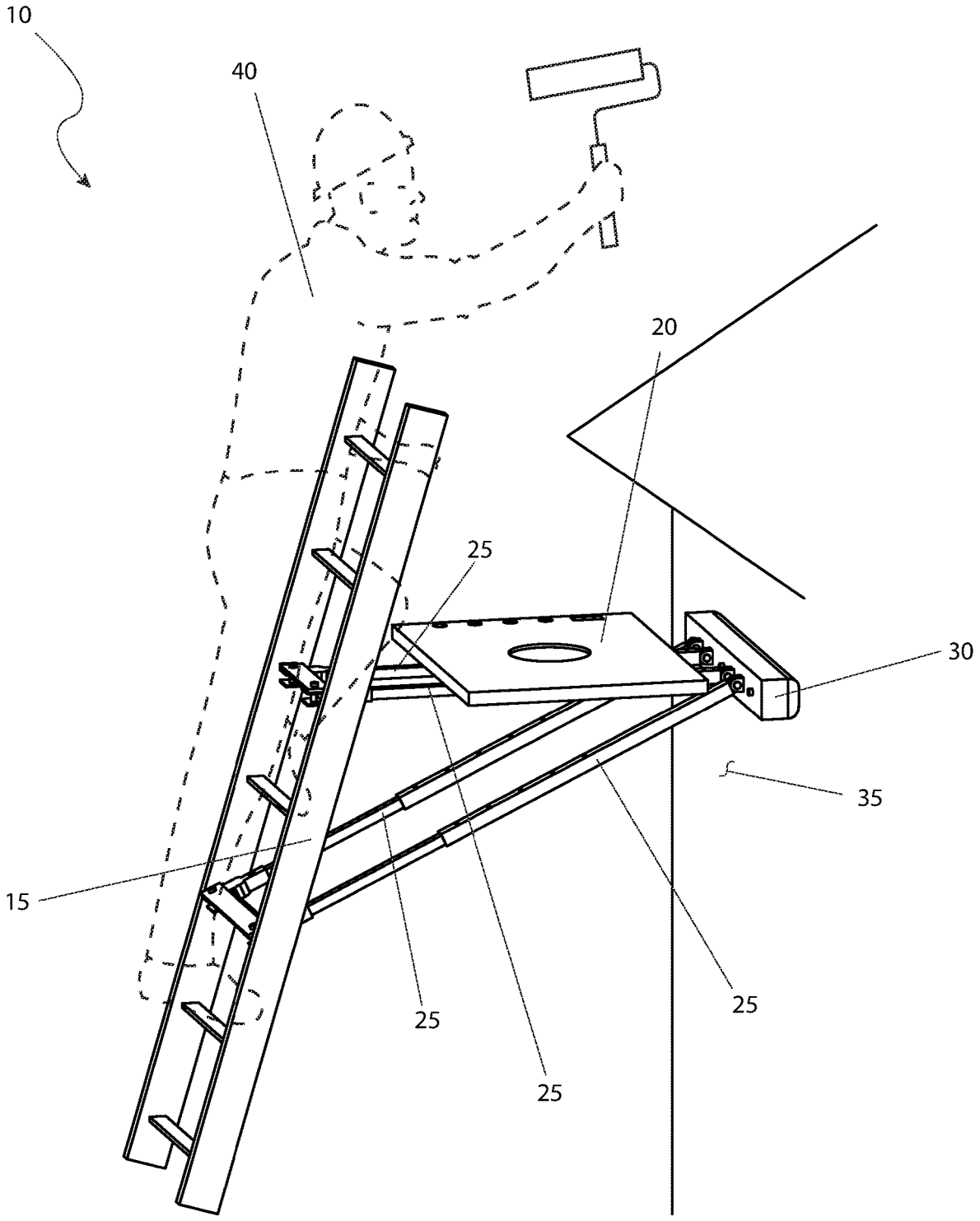
FIG. 1 is a pictorial view of an extension ladder work platform standoff system 10, according to the preferred embodiment of the present invention.

10 extension ladder work platform standoff system
15 extension ladder
20 tray
25 support structure
30 non-slip pad
35 vertical elevated surface
40 user
45 upper support arm
50 lower support brace
55 upper rung
60 lower rung
65 "U" shaped connector
70 spring clip
75 travel path
80 central opening
85 multiple slot opening
90 raised outer rim
95 lower extension of the central opening
100 mounting plate
105 fastener
110 pad block
115 mounting slot
120 side opening
125 first pin opening
130 first half upper support arm
135 first connector
140 second half upper support arm
145 second connector
150 connecting tab
155 first half lower support brace
160 third connector
165 second half lower support brace
170 adjustable length connector
175 length adjustment opening
180 support plate brace
185 second pin opening

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, a pictorial view of the extension ladder work platform standoff system 10, according to the preferred embodiment of the present invention is disclosed. The extension ladder work platform standoff system 10 (herein described as the "device") 10, attaches to a standard extension ladder 15. The system 10 includes three (3) main components: a tray 20; a support structure 25; and a non-slip pad 30. The tray 20 can be used to hold paint cans, paint trays, tools, supplies and the like. The support structure 25 includes multiple supporting members that serve as a brace to hold both the tray 20 and the non-slip pad 30, but also serve to support the extension ladder 15 away from a vertical elevated surface 35 such as a wall, house, gutter or the like.

The support provides access to items such as gutters, soffit or fascia without damaging said items as the support structure 25 allows bearing of the weight of the extension ladder 15 and a user 40 against other more suitable and durable surfaces. The non-slip pad 30 supports all bearing weight and provides two important benefits. First, the pad nature of the non-slip pad 30 provides cushioning for any protruding objects on the face of the vertical elevated surface 35 thus preventing damage such as scuffing. Second, the non-slip nature of the non-slip pad 30 ensures that the extension ladder 15 will not slip and fall should the user 40 go slightly off-center axis. Further description of the tray 20, the support structure 25, and the non-slip pad 30 will be provided herein below.

Figure 2:
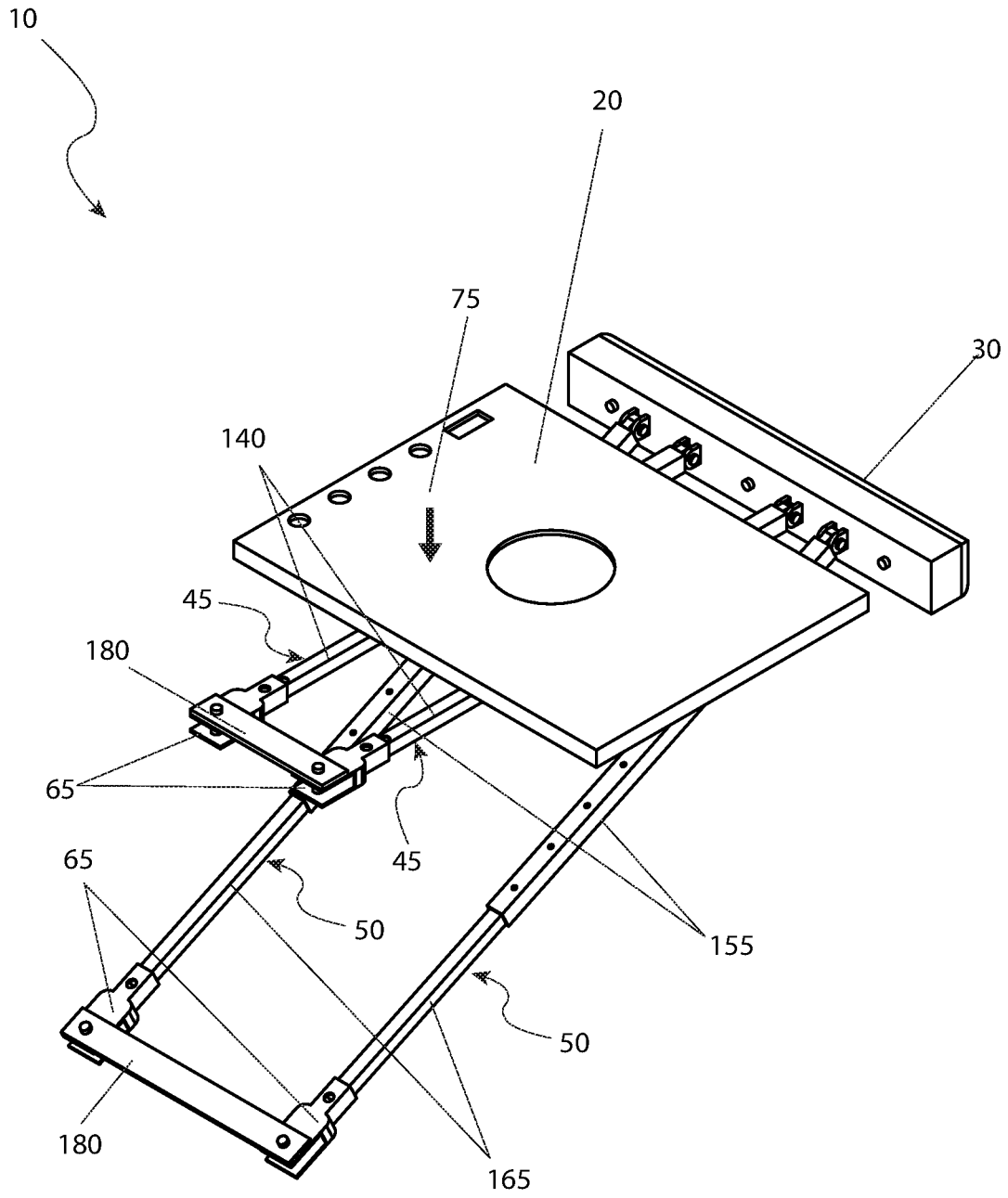
FIG. 2 is a top side perspective view of the system 10, according to the preferred embodiment of the present invention.
Figure 3:
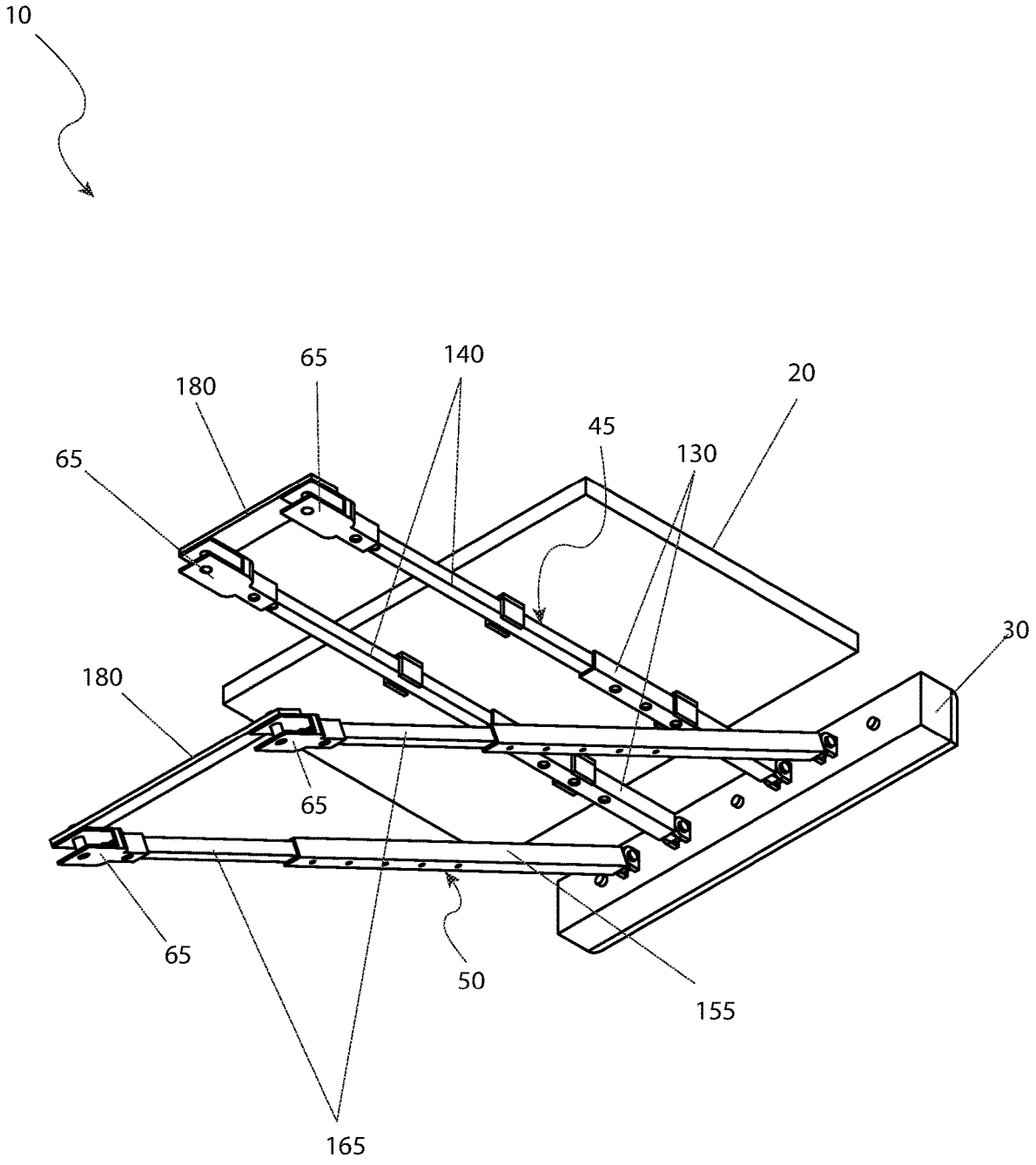
FIG. 3 is a bottom side perspective view of the system 10, according to the preferred embodiment of the present invention.

Referring next to FIGS. 2 and 3, a top side perspective view of the system 10, and a bottom side perspective view of the system 10, according to the preferred embodiment of the present invention is depicted. This figure provides clearer definition on the interconnecting nature of the components of the system 10. The support structure 25 includes two (2) upper support arms 45 (of which only one (1) is shown due to illustrative limitations) and two (2) lower support braces 50 (of which only one (1) is shown due to illustrative limitations). The upper support arms 45 is connected at the distal end to the non-slip pad 30 and at the proximal end to an upper rung 55 on the extension ladder 15. The lower support brace 50 is connected at the distal end to the non-slip pad 30 and at the proximal end to a lower rung 60 on the extension ladder 15. The lower rung 60 is envisioned to be two (2) rungs below the upper rung 55 for extension ladder 15 placed at a normal access angle.

The connection of the upper support arms 45 and the lower support brace 50 to the upper rung 55 and the lower rung 60 respectively are facilitated by four (4) "U"-shaped connectors 65 (of which only two (2) are shown due to illustrative limitations). Further description of the "U"-shaped connector 65 will be provided herein below. The tray 20 is connected horizontally across the two (2) upper support arms 45 (of which only one (1) is shown due to illustrative limitations) by use of four (4) spring clips 70 (of which only two (2) is shown due to illustrative limitations). Installation of the tray 20 is accomplished by pushing the tray 20 along a travel path 75 whereupon the tray 20 is held in place by friction fit.

Figure 4B:
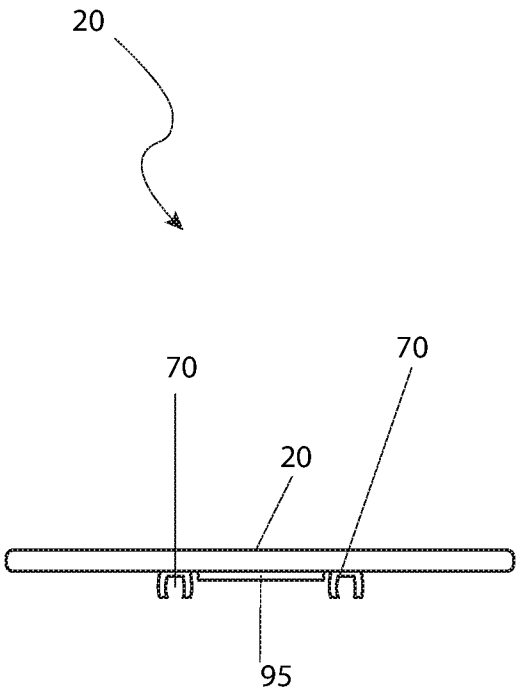
FIG. 4*b* is a side view of the tray 20 as used with the system 10, according to the preferred embodiment of the present invention.
Figure 4A:
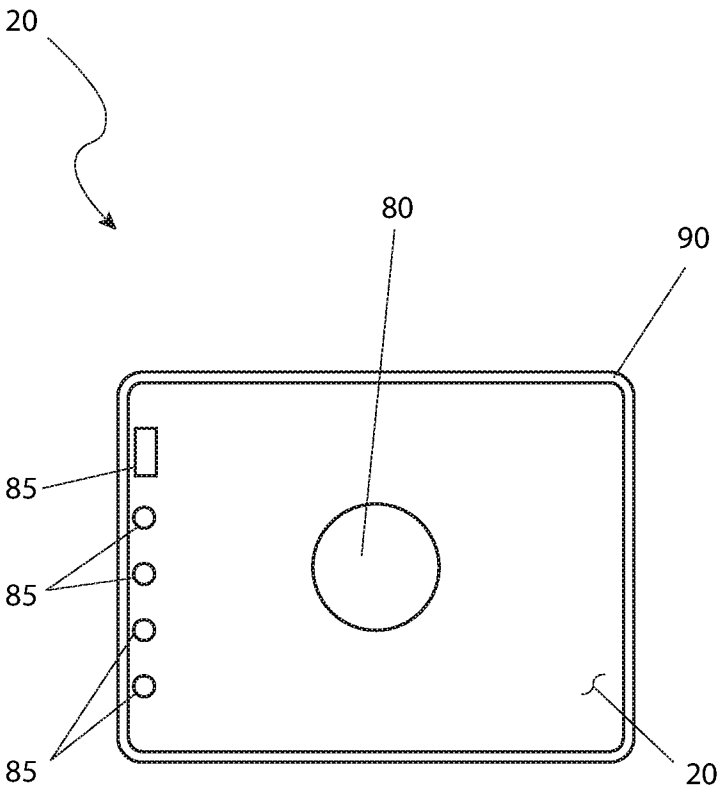
FIG. 4*a* is a front view of the tray 20 as used with the system 10, according to the preferred embodiment of the present invention.

Referring now to FIG. 4*a*, a front view of the tray 20 as used with the system 10, according to the preferred embodiment of the present invention is shown. The tray 20 is envisioned to be manufactured from a composite material, although other materials such as plastic, steel, aluminum, and the like can be used with equal effectiveness, and as such, the use of any specific material of construction should not be interpreted as a limiting factor of the present invention. The tray 20 is approximately eighteen inches (18 in.) deep and twenty-four inches (24 in.) wide. The tray 20 is provided with a central opening 80 for use in holding paint cans, tool buckets, or other circular objects (note that the central opening 80 is closed on the bottom), a series of multiple slot openings 85 for holding tools such as screwdrivers, pliers, hammers, utility knives, or the like, and a raised outer rim 90, to prevent tools or material from falling off.

Referring next to FIG. 4*b*, a side view of the tray 20 as used with the system 10, according to the preferred embodiment of the present invention is disclosed. This figure depicts a lower extension of the central opening 95 to allow for secure placement of any round objects within the central opening 80 (as shown in FIG. 4*a*). Additionally, the spring clips 70 (two (2) of four (4) total shown) are depicted in a manner which exposed their spring nature and ability to hold the upper support arms 45 (as shown in FIG. 3).

Figure 5B:
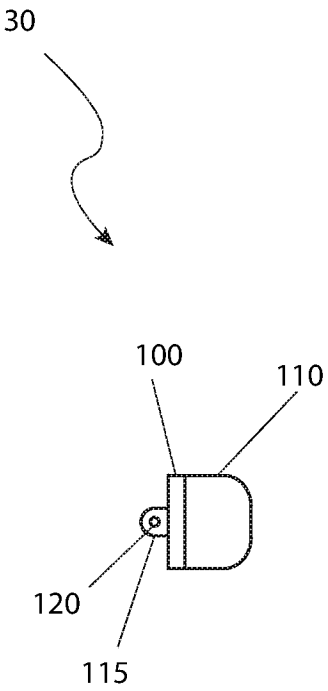
FIG. 5*b* is a side view of the non-slip pad 30 as used with the system 10, according to the preferred embodiment of the present invention.
Figure 5A:
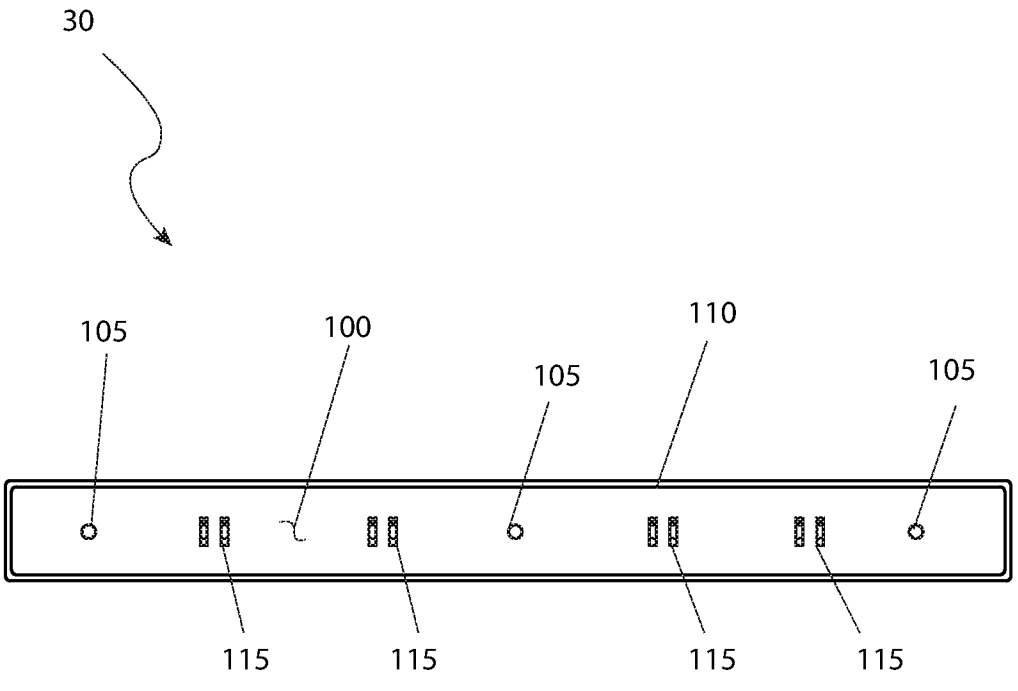
FIG. 5*a* is a rear view of the non-slip pad 30 as used with the system 10, according to the preferred embodiment of the present invention.

Referring now to FIG. 5*a*, a rear view of the non-slip pad 30 as used with the system 10, according to the preferred embodiment of the present invention is depicted. The non-slip pad 30 is provided with a mounting plate 100, envisioned to be made of steel or other material of suitable strength. The mounting plate 100 is provided with three (3) fasteners 105 such as screws or rivets for holding the pad block 110 around the perimeter and on the opposite side. Additionally, the mounting plate 100 is provided with four (4) mounting slots 115 for holding the distal end of the two (2) upper support arms 45 (as shown in FIG. 2) and the two (2) lower support braces 50 (as shown in FIGS. 2 and 3). The mounting slots 115 are provided with side openings 120 for acceptance of a fastener such as screw, bolt, or pin (not shown). In at least one (1) embodiment, a pair of mounting slots 115 located on the inside of the mounting plate 100 are configured to secure the two (2) upper support arms 45 and a pair of mounting slots 115 located on the outside of the mounting plate 100 are configured to secure the two (2) lower support braces 50.

Referring next to FIG. 5*b*, a side view of the non-slip pad 30 as used with the system 10, according to the preferred embodiment of the present invention is shown. This figure provides disclosure of aforementioned side openings 120 located in the mounting slots 115 on the mounting plate 100. The pad block 110 is envisioned to be made of rubber, closed cell polyethylene foam, polyurethane foam, latex foam or the like. The pad block 110 would be approximately two inches (2 in.) deep and three inches (3 in.) high. The length of the pad block 110 would vary on the width of the extension ladder 15 (as shown in FIG. 1) upon which the system 10 is used, but would be approximately thirty inches (30 in.) long in a typical application.

Figure 6:
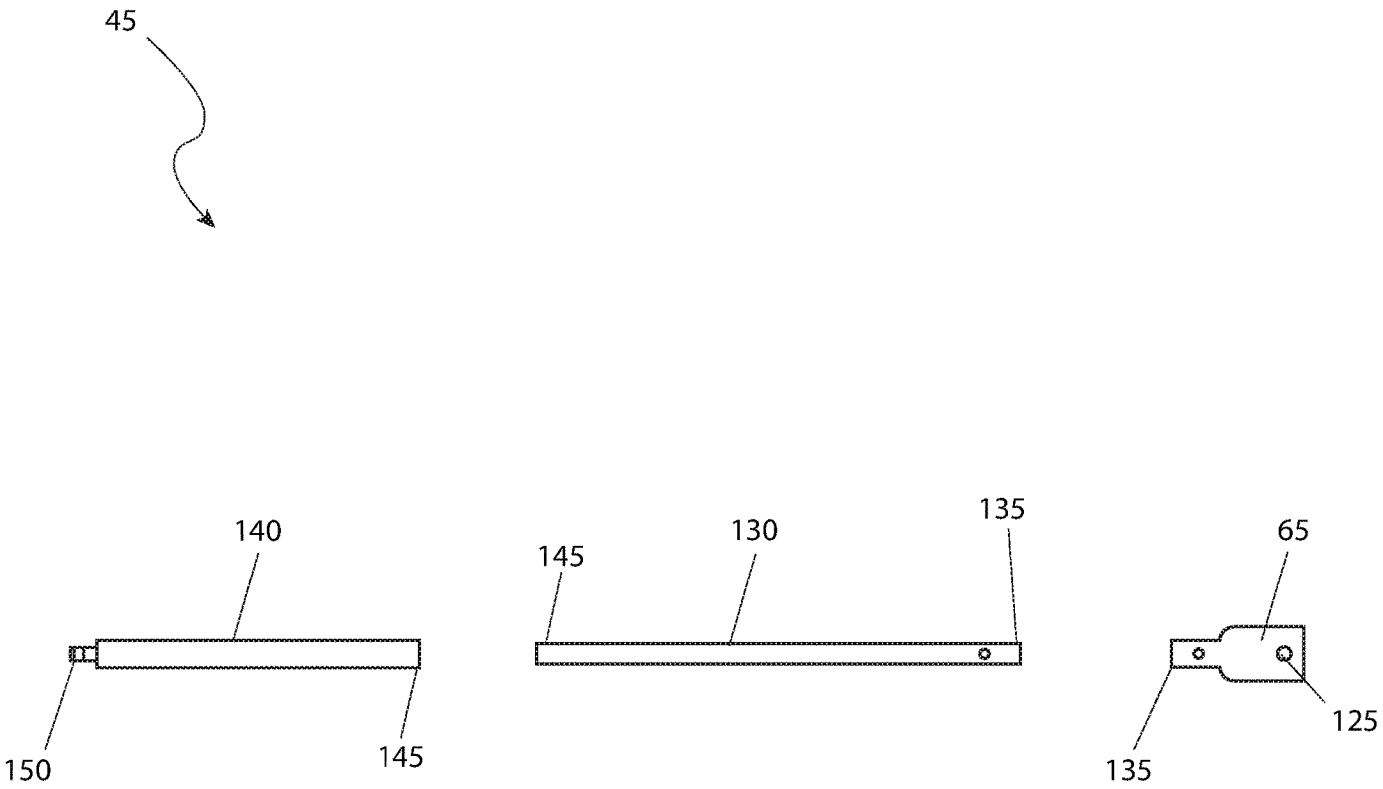
FIG. 6 is a front view of the upper support arms 45 as used with the system 10, according to the preferred embodiment of the present invention.

Referring now to FIG. 6, a front view of the upper support arms 45 as used with the system 10, according to the preferred embodiment of the present invention is disclosed. The assembly of the upper support arms 45 includes three (3) major components. The "U"-shaped connector 65 (one (1) of four (4)) is located at one (1) end and is provided with a first pin opening 125 for securement by a pin, cotter pin, or similar device. It is connected to a first half upper support arm 130 by a first connector 135 such as a pinned connection, a threaded connection, a snap connection or the like. Likewise, the first half upper support arm 130 is connected to a second half upper support arm 140 by use of a second connector 145. The far end of the second half upper support arm 140 is provide with a connecting tab 150 which connects to the mounting slots 115 (as shown on FIG. 5*a*) of the mounting plate 100 (as shown in FIG. 5*b*).

Figure 7:
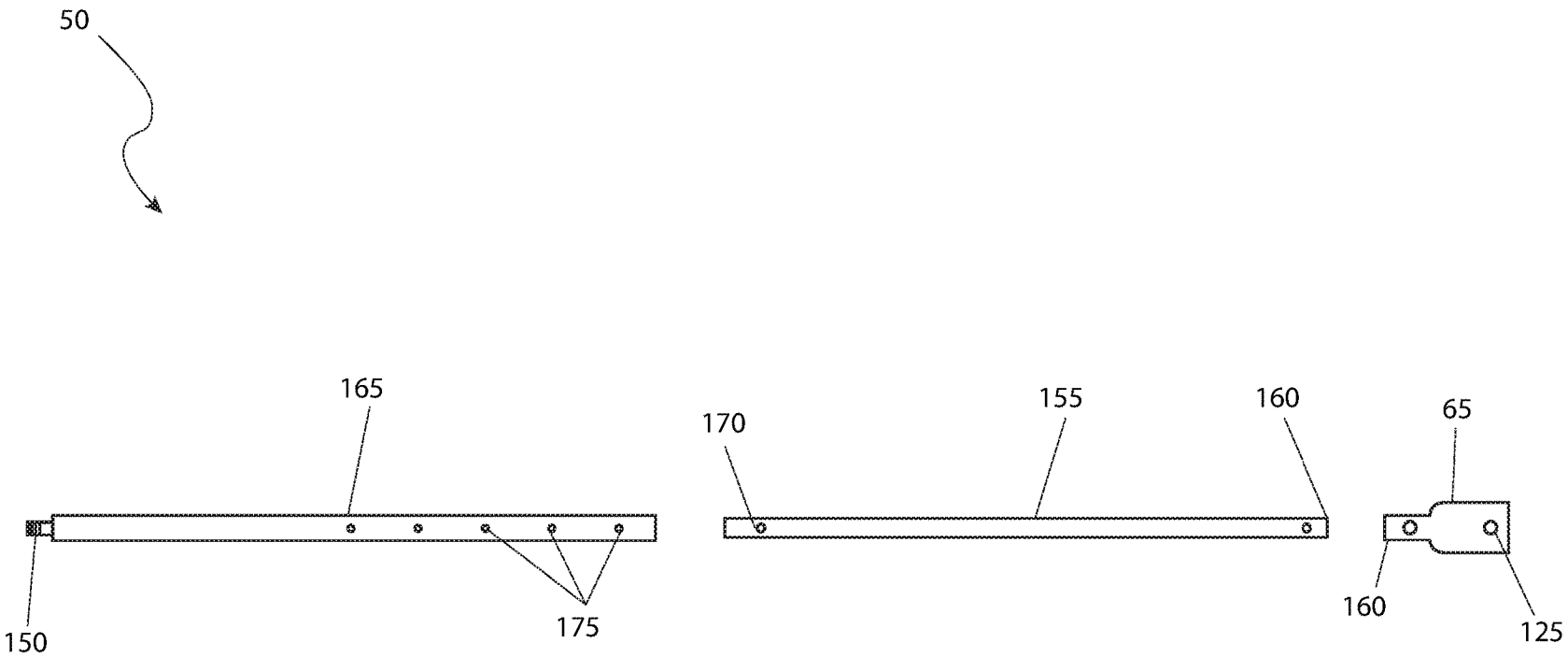
FIG. 7 is a front view of the lower support brace 50 as used with the system 10, according to the preferred embodiment of the present invention; and, FIG. 8 is a front view of the support plate brace 180 as used with the system 10, according to the preferred embodiment of the present invention.

Referring next to FIG. 7, a front view of the lower support brace 50 as used with the system 10, according to the preferred embodiment of the present invention is depicted. The assembly of the lower support brace 50 includes three (3) major components. The "U"-shaped connector 65 (one (1) of four (4)) is located at one (1) end and is provided with the first pin opening 125 for securement by a pin, cotter pin, or similar device. It is connected to a first half lower support brace 155 by a third connector 160 such as a pinned connection, a threaded connection, a snap connection or the like. The first half lower support brace 155 is then connected to a second half lower support brace 165 by use of an adjustable length connector 170. The adjustable length connector 170 allows for adjustment of the overall length of the lower support brace 50 to ensure that the tray 20 (as shown in FIG. 1) remain level. This adjustment would be required by environmental differences such as angle of the extension ladder 15 (as shown in FIG. 1), user preferences, and the like. Length adjustment is accomplished by a series of length adjustment openings 175 using a spring pin (not shown). The far end of the second half upper support arm 140 is provide with another connecting tab 150 which connects to the mounting slots 115 (as shown on FIG. 5*a*) of the mounting plate 100 (as shown in FIG. 5*b*).

Figure 8:
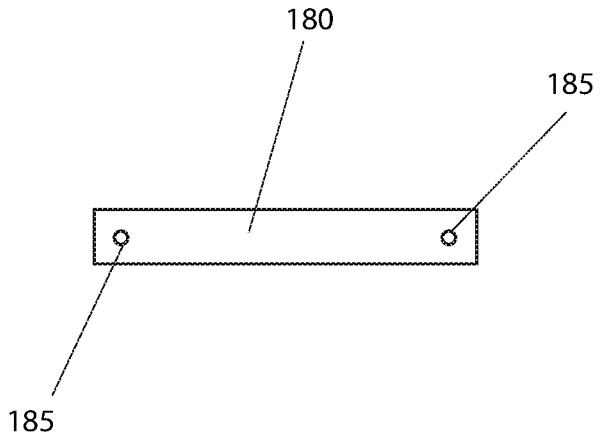

Referring finally to FIG. 8, a front view of the support plate brace 180 as used with the system 10, according to the preferred embodiment of the present invention is depicted. The support plate brace 180 is envisioned to be manufactured from a steel plate with the approximate dimensions of three-quarters of an inch (¾ in.) wide, one-eighth of an inch (⅛ in.) thick and fifteen to eighteen inches (15-18 in.) wide. It is provided with two (2) second pin openings 185 at each end. Each second pin opening 185 is intended to line up with a first pin opening 125 (as shown in FIGS. 6 and 7) of the four (4) "U"-shaped connector 65 (as shown in FIGS. 6 and 7) on both the upper support arms 45 (as shown in FIGS. 6 and 7) and lower support brace 50 (as shown in FIGS. 6 and 7) near the end of the extension ladder 15. Such placement prevents the upper support arms 45 (as shown in FIGS. 6 and 7) and lower support brace 50 (as shown in FIGS. 6 and 7) from moving inward and preventing subsequent collapse of the system 10.

The preferred embodiment of the present invention can be utilized by the common user in a simple and effortless manner with little or no training. It is envisioned that the system 10 would be constructed in general accordance with FIG. 1 through FIG. 8.

After procurement of the system 10 it would be utilized in the following manner. First, attach the upper support arms 45 to the upper rung 55 using two (2) of the "U"-shaped connector 65 along with a pin and the support plate brace 180; attach the lower support brace 50 to the lower rung 60 using the other two (2) of the "U"-shaped connector 65 along with a pin and the other support plate brace 180; adjust the length of the lower support brace 50 using the adjustable length connector 170; attach the opposite end of both upper support arms 45 and both lower support brace 50 to the mounting plate 100 using fasteners 105; snap the tray 20 onto both upper support arms 45 using the spring clips 70 along a travel path 75. Finally, ensure that the extension ladder 15 is on stable grade. At this point in time the system 10 is ready to be utilized.

During utilization, various tools and supplies are placed upon the tray 20 to allow for more efficient and safer work at elevated heights. Any variations in center of gravity of the user 40 are more readily accommodated, the large surface area of the non-slip pad 30 prevents damage to the vertical elevated surface 35 and prevents slippage. After use, the abovementioned process is reversed to remove the system 10 whereupon it is stored for reuse at a future time in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A ladder platform device, comprising:

a tray;

a non-slip pad; and, a plurality of lengthwise support structures;

wherein lengthwise support structures are removably secured to an underside portion of said tray;

wherein a first end of each said lengthwise support structures are removably secured to a first side of said non-slip pad, a first support structure includes a first upper support arm and a first lower support arm;

wherein a second end of a first pair of each said lengthwise support structures are removably secured to a first ladder rung;

wherein a second end of a second pair of each said lengthwise support structures are removably secured to a second ladder rung, a second support structure includes a second upper support arm and a second lower support arm; and, wherein the first upper support arm, the second upper support arm, the first lower support arm and the second lower support arm are directly attached to said first side of said non-slip pad at a common horizontal line of attachment wherein said non-slip pad is leaned against a vertical support structure thereby presenting said tray in a horizontal manner suitable for a usable surface for a user of a ladder;

wherein said non-slip comprises:

a first pad fastener secured to said first side of said non-slip pad;

a second pad fastener secured to said first side of said non-slip pad, adjacent said first pad fastener;

a third pad fastener secured to said first side of said non-slip pad, adjacent said second pad fastener; and, a fourth pad fastener secured to said first side of said non-slip pad, adjacent said third pad fastener;

wherein said non-slip pad further comprises a pad block disposed on a second side of said non-slip pad, opposite said non-slip pad first side;

wherein said underside portion of said tray further comprises:

a first spring clip adjacent a first tray corner;

a second spring clip adjacent a second tray corner;

a third spring clip adjacent a third tray corner; and, a fourth spring clip adjacent a fourth tray corner;

wherein said first upper support arm comprises:

a first upper support arm connector, having a first upper support arm connector first side and a first upper support arm connector second side;

a first upper support arm first half, having a first upper support arm first half first end removably secured to said first upper support arm connector second side, and also having a first upper support arm first half second end;

a first upper support arm second half, having a first upper support arm second half first end removably secured to said first upper support arm first half second end, and also having a first upper support arm second half second end; and, a first upper support arm connection tab secured to said first upper support arm second half second end;

wherein said first upper support arm connector is secured to said first ladder rung;

wherein said first upper support arm is removably secured between said first spring clip and said second spring clip;

wherein said tray further comprises a plurality of apertures and at least one depression.

2. The device of claim 1, wherein said second upper support arm comprises:

a second upper support arm connector, having a second upper support arm connector first side and a second upper support arm connector second side;

a second upper support arm first half, having a second upper support arm first half first end removably secured to said second upper support arm connector second side, and also having a second upper support arm first half second end;

a second upper support arm second half, having a second upper support arm second half first end removably secured to said second upper support arm first half second end, and also having a second upper support arm second half second end; and, a second upper support arm connection tab secured to said second upper support arm second half second end;

wherein said second upper support arm connector is removably secured to said first ladder rung adjacent said first upper support arm connector;

wherein said second upper support arm is removably secured between said third spring clip and said fourth spring clip;

wherein said second upper support arm connection tab is removably secured to said third pad fastener; and, wherein a first support brace is secured at a first support brace end between said first upper support arm connector and said second upper support arm connector.

3. The device of claim 2, wherein said first lower support arm comprises:

a first lower support arm connector, having a first lower support arm connector first side and a first lower support arm connector second side;

a first lower support arm first half, having a first lower support arm first half first end removably secured to said first lower support arm connector second side, and also having a first lower support arm first half second end;

a first lower support arm second half, having a first lower support arm second half first end removably secured to said first lower support arm first half second end, and also having a first lower support arm second half second end; and, a first lower support arm connection tab secured to said first lower support arm second half second end;

wherein said first lower support arm connector is removably secured to said second ladder rung subjacent said first ladder rung; and, wherein said first lower support arm connection tab is removably secured to said first pad fastener.

4. The device of claim 3, wherein said second lower support arm comprises:

a second lower support arm connector, having a second lower support arm connector first side and a second lower support arm connector second side;

a second lower support arm first half, having a second lower support arm first half first end removably secured to said second lower support arm connector second side, and also having a second lower support arm first half second end;

a second lower support arm second half, having a second lower support arm second half first end removably secured to said second lower support arm first half second end, and also having a second lower support arm second half second end; and, a second lower support arm connection tab secured to said second lower support arm second half second end;

wherein said second lower support arm connector is removably secured to said second ladder rung adjacent said first lower support arm connector;

wherein said second lower support arm connection tab is removably secured to said fourth pad fastener; and, wherein a second support brace is secured at each second support brace end between said first lower support arm connector and said second lower support arm connector.

5. A ladder platform device, comprising:

a tray;

a non-slip pad; and, a plurality of lengthwise adjustable support structures;

wherein at least two of said lengthwise adjustable support structures are removably secured to an underside portion of said tray;

wherein a first end of each said lengthwise adjustable support structures are removably secured to a first side of said non-slip pad, a first support structure includes a first upper support arm and a first lower support arm;

wherein a second end of a first pair of each said lengthwise adjustable support structures are removably secured to a first ladder rung;

wherein a second end of a second pair of each said lengthwise adjustable support structures are removably secured to a second ladder rung, a second support structure includes a second upper support arm and a second lower support arm; and, wherein the first upper support arm, the second upper support arm, the first lower support arm and the second lower support arm are directly attached to said first side of said non-slip pad at a common horizontal line of attachment wherein said non-slip pad is leaned against a vertical support structure thereby presenting said tray in a horizontal manner suitable for a usable surface for a user of a ladder;

wherein said non-slip comprises:

a first pad fastener secured to said first side of said non-slip pad;

a second pad fastener secured to said first side of said non-slip pad, adjacent said first pad fastener;

a third pad fastener secured to said first side of said non-slip pad, adjacent said second pad fastener; and, a fourth pad fastener secured to said first side of said non-slip pad, adjacent said third pad fastener;

wherein said non-slip pad further comprises a pad block disposed on a second side of said non-slip pad, opposite said non-slip pad first side;

wherein said underside portion of said tray further comprises:

a first spring clip adjacent a first tray corner;

a second spring clip adjacent a second tray corner;

a third spring clip adjacent a third tray corner; and, a fourth spring clip adjacent a fourth tray corner;

wherein said first upper support arm comprises:

a first upper support arm connector, having a first upper support arm connector first side and a first upper support arm connector second side;

a first upper support arm first half, having a first upper support arm first half first end removably secured to said first upper support arm connector second side, and also having a first upper support arm first half second end;

a first upper support arm second half, having a first upper support arm second half first end removably secured to said first upper support arm first half second end, and also having a first upper support arm second half second end; and, a first upper support arm connection tab secured to said first upper support arm second half second end;

wherein said first upper support arm connector is secured to said first ladder rung;

wherein said first upper support arm is removably secured between said first spring clip and said second spring clip; and, wherein said underside portion of said tray further comprises:

a first spring clip adjacent a first tray corner;

a second spring clip adjacent a second tray corner;

a third spring clip adjacent a third tray corner; and, a fourth spring clip adjacent a fourth tray corner;

wherein said first upper support arm comprises:

a first upper support arm connector, having a first upper support arm connector first side and a first upper support arm connector second side;

a first upper support arm first half, having a first upper support arm first half first end removably secured to said first upper support arm connector second side, and also having a first upper support arm first half second end;

a first upper support arm second half, having a first upper support arm second half first end removably secured to said first upper support arm first half second end, and also having a first upper support arm second half second end; and, a first upper support arm connection tab secured to said first upper support arm second half second end;

wherein said first upper support arm connector is secured to said first ladder rung;

wherein said first upper support arm is removably secured between said first spring clip and said second spring clip;

wherein said tray further comprises a plurality of apertures and at least one depression.

6. The device of claim 5, wherein said second upper support arm comprises:

a second upper support arm connector, having a second upper support arm connector first side and a second upper support arm connector second side;

a second upper support arm first half, having a second upper support arm first half first end removably secured to said second upper support arm connector second side, and also having a second upper support arm first half second end;

a second upper support arm second half, having a second upper support arm second half first end removably secured to said second upper support arm first half second end, and also having a second upper support arm second half second end; and, a second upper support arm connection tab secured to said second upper support arm second half second end;

wherein said second upper support arm connector is removably secured to said first ladder rung adjacent said first upper support arm connector;

wherein said second upper support arm is removably secured between said third spring clip and said fourth spring clip;

wherein said second upper support arm connection tab is removably secured to said third pad fastener; and, wherein a first support brace is secured at a first support brace end between said first upper support arm connector and said second upper support arm connector.

7. The device of claim 6, wherein said first lower support arm comprises:

a first lower support arm connector, having a first lower support arm connector first side and a first lower support arm connector second side;

a first lower support arm first half, having a first lower support arm first half first end removably secured to said first lower support arm connector second side, and also having a first lower support arm first half second end;

a first lower support arm second half, having a first lower support arm second half first end removably secured to said first lower support arm first half second end, and also having a first lower support arm second half second end; and, a first lower support arm connection tab secured to said first lower support arm second half second end;

wherein said first lower support arm connector is removably secured to said second ladder rung subjacent said first ladder rung; and, wherein said first lower support arm connection tab is removably secured to said first pad fastener.

8. The device of claim 7, wherein said second lower support arm comprises:

a second lower support arm connector, having a second lower support arm connector first side and a second lower support arm connector second side;

a second lower support arm first half, having a second lower support arm first half first end removably secured to said second lower support arm connector second side, and also having a second lower support arm first half second end;

a second lower support arm second half, having a second lower support arm second half first end removably secured to said second lower support arm first half second end, and also having a second lower support arm second half second end; and, a second lower support arm connection tab secured to said second lower support arm second half second end;

wherein said second lower support arm connector is removably secured to said second ladder rung adjacent said first lower support arm connector;

wherein said second lower support arm connection tab is removably secured to said fourth pad fastener; and, wherein a second support brace is secured at each second support brace end between said first lower support arm connector and said second lower support arm connector.

* * * * *